United States Patent [19]

Lattner

[11] Patent Number: 4,656,695

[45] Date of Patent: Apr. 14, 1987

[54] DRAFTING ASSEMBLY FOR A SPINNING MACHINE

[75] Inventor: Manfred Lattner, Ebersbach/Fils, Fed. Rep. of Germany

[73] Assignee: Zinser Textilmaschinen GmbH, Ebersbach, Fed. Rep. of Germany

[21] Appl. No.: 733,555

[22] Filed: May 13, 1985

[30] Foreign Application Priority Data

May 11, 1984 [DE] Fed. Rep. of Germany ..... 3417516

[51] Int. Cl.[4] ..... D01H 5/88

[52] U.S. Cl. ..... 19/236; 19/253; 19/255

[58] Field of Search ..... 19/238, 244, 252, 253, 19/254, 255

[56] References Cited

U.S. PATENT DOCUMENTS

| | | | |
|---|---|---|---|
| 1,895,800 | 1/1933 | Jessen | 19/252 X |
| 2,677,858 | 5/1954 | Kuehn et al. | 19/254 |
| 3,050,789 | 8/1962 | Rogner | 19/252 |
| 3,129,467 | 4/1964 | Swanson | 19/255 |
| 3,561,065 | 2/1971 | MacDonald | 19/255 |
| 3,600,759 | 8/1971 | Grishin | 19/255 |
| 4,391,021 | 7/1983 | Kamel | 19/253 |

FOREIGN PATENT DOCUMENTS

| | | | |
|---|---|---|---|
| 658267 | 10/1951 | United Kingdom | 19/252 |

*Primary Examiner*—Louis K. Rimrodt
*Assistant Examiner*—J. L. Olds
*Attorney, Agent, or Firm*—Karl F. Ross; Herbert Dubno

[57] ABSTRACT

A drafting assembly whose lower belt is laterally guided by a guide element having a pair of side walls joined by a web and more unitarily from a synthetic resin. The web lies outside the loop of the lower belt and in the upper belt or adjacent the lower belt. The element is held against lateral movements by abutments which can be lateral flanks of the rollers or a guide element for the upper belt. The element is prevented from twisting or rotation by engagement with a stationary turnover rail over which the lower belt passes.

4 Claims, 10 Drawing Figures

DRAFTING ASSEMBLY FOR A SPINNING MACHINE

CROSS REFERENCE TO RELATED APPLICATION

This application is related to my commonly assigned copending application Ser. No. 697,733 filed Feb. 4, 1985 and entitled Spinning Machine Drafting Frame.

FIELD OF THE INVENTION

My invention relates to a drafting or drawing assembly for a spinning machine and, more particularly, to a drafting assembly which comprises a stationary turnover rail which cooperates with a lower roller about which a lower belt passes and with an upper roller about which an upper belt passes, the roving, fiber, yarn or sliver being passed between these belts in a spinning frame. More particularly, the invention relates to improved guidance for the lower belt of such an assembly.

BACKGROUND OF THE INVENTION

Drafting assemblies of the aforedescribed type are illustrated, for example, in the above-identified application and serve to draw out the roving or yarn which is to be spun in the spinning frame upon which one or more such assemblies may be mounted for each of the spinning stations. In the past means has been provided to laterally guide the lower belts and prevent them from shifting off the respective roller along the turnover rail which may be common to a number of such assemblies arrayed along the spinning frame for association with the respective spinning station.

The lower roller of the assembly is generally located in a fixed position on the spinning frame and to provide lateral guidance of a lower belt which passes around such a roller, it has been proposed to utilize a retaining cage or the like. The cage must be inserted through the loop of the lower roller. This complicates matters because it is desirable to be able to remove or to clean the cage.

The problem of removing such cages is complicated because the turnover rail itself must be passed through the loops of the lower belts of the entire set of assemblies to which this rail may be common. In the past complex guide systems had to be provided or arrangements had to be made to enable disassembly of the lower roller or rail to allow the lateral guide means to be inserted, replaced, cleaned or maintained.

OBJECTS OF THE INVENTION

It is, therefore, the principal object of the present invention to provide a drawing assembly for the drafting means of a spinning frame whereby these disadvantages are obviated.

A more specific object of this invention is to provide improved lateral guide means for the lower belt of a drafting assembly which enables the lateral guide means to be cleaned, replaced or maintained in a nonproblematic manner.

Still another object of my invention is to provide a drafting assembly of the type described with improved lateral guide means for the lower belt such that replacement and cleanining can be effected with comparative ease.

SUMMARY OF THE INVENTION

These objects and others which will become apparent hereinafter are attained, in accordance with the present invention, in an assembly which provides a lateral belt guide for the lower belt of the assembly, the guide comprising a pair of side walls lying in planes parallel to one another and bridged by a transverse web which lies externally of the lower belt and can be positioned so that the side walls closely flank and laterally guide the lower belt at respective guide locations while at other locations, the guide element is in engagement with or is engageable with abutments fixed with respect to the assembly while at other locations the element is retained against rotation with the belt by engagement with the turnover rail. The web can lie externally of the lower belt in this construction and thus the lateral guide element as a unit can be radially replaced or cleaned.

The abutments against which the lateral walls can brace can be fixedly located parts of the assembly and in a preferred embodiment of the invention, the flanks defined by these side walls can be prevented from shifting laterally by abutment with the flanks of the upper roller, the flanks of the running surface of the lower roller or lateral parts of an upper belt cage if one is provided.

In an especially preferred construction of the invention, the lateral walls in the web are united into a member which is passed through the loop of the upper belt. Since the upper belt does not generally pass around any fixed turnover rail, the upper belt can be easily removed or detensioned by comparison with the lower and thus removal and replacement of the lateral guide element is greatly simplified.

In an alternative construction of the invention the lateral walls project over the edges of the upper and lower belt, i.e. project from above downwardly over the edges of the lower pass of the upper belt or project from a side over the edges of the belts with the projecting portions of the lateral guide element resting against the turnover rail. In this case, the turnover rail prevents rotation or twisting of the lateral guide element and the lateral movements are prevented by the side walls and their engagement with the flanks of the rollers or the flanks of the upper belt. No additional abutments or retainers are required and a simple threading of the lateral guide element in the loop of the upper belt will position the guide element for the purposes of this invention.

According to another feature of the invention the lateral walls engage from above over the edge of the upper and lower belts and from below over an upper belt cage while the lower edges of the side walls rest from above upon the turnover rail. In this case, the abutments are not formed by the upper roller but by parts of the upper belt cage for the side walls of the lower belt guide of this invention.

In yet another configuration of the invention, the side walls are formed as upwardly cut away rings and the web is a cylindrical segment. Here the web can be provided around and along the rear of the lower roller and the turnover rail can extend into the cutout of the lateral walls to restrict rotation of the lower belt guide element.

When the rings have an angular extent or circumferential dimension which is somewhat greater than a semi-circle, they can be clipped over the lower roller and thus can be retained thereon against movement away from the stationary rail.

For this purpose, the lateral guide element can be composed of a somewhat elastic synthetic resin, preferably a low-friction synthetic resin which can be injection-molded. Nylon and polytetrofluoroethylene can be used to fabricate the lateral guide element as well.

According to another feature of the invention, the rings, i.e. the side walls, overlap the flanks of the running surface of the lower roller and at the same time the edges of the lower belt. Alternatively, the lateral guide element can be so formed that the rings overlap the edges of the lower belt and the upper belt as well as the flank of the upper roller. In this latter case the flanks of the upper roller form the abutments.

BRIEF DESCRIPTION OF THE DRAWING

The above and other objects, features and advantages of the present invention will become more readily apparent from the following description, reference being made to the accompanying drawing, in which.

SPECIFIC DESCRIPTION

Figure 1:
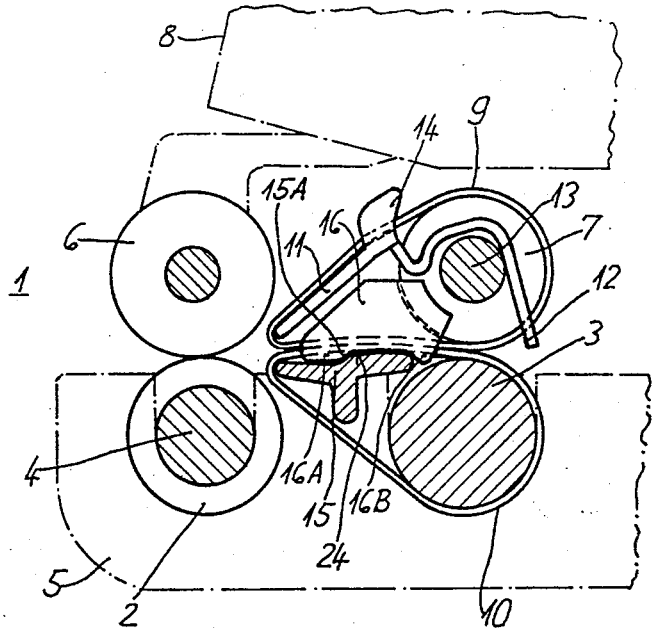
FIG. 1 is a vertical section through a drafting assembly in accordance with the invention.
Figure 3A:
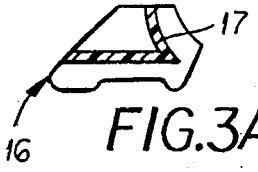
FIG. 3A is a section taken along the line IIIA—IIIA of FIG. 3.
Figure 3:
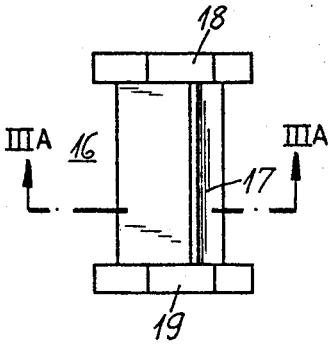
FIG. 3 is a plan view of the lateral guide element of the invention used in the assembly of FIGS. 1 and 2.

In a first embodiment of the invention illustrated in FIGS. 1–3 and 3A, the drafting assembly 1 forming the terminal drafting unit of a drafting frame (see the abovementioned copending application) comprises a first lower roller 2 and a second lower roller 3. The shaft 4 of the lower roller 2 and the lower roller 3 are journaled in the machine frame or support shown in dot-dash lines and represented at 5.

The lower rollers 2 and 3 cooperate with upper rollers 6 and 7. A loading arm or carrier 8 for pressing the upper rollers downwardly toward the lower rollers has been shown in dot-dash lines and may be of the construction illustrated and described in application Ser. No. 697,733 which also describes the overall operation of such a drafting frame.

An endless upper belt 9 passes around the upper roller 7 while an endless lower belt 10 passes around the lower roller 3, the upper belt having a lower pass and the lower belt having an upper pass, these passes meeting to entrain the yarn between them.

The upper belt is guided over an upper belt cage 11 of conventional design which has a pair of retaining arms 12 passing over the shaft 13 of the upper roller and flanking the running surface thereof adjacent the flanks 22 and 23.

Figure 2:
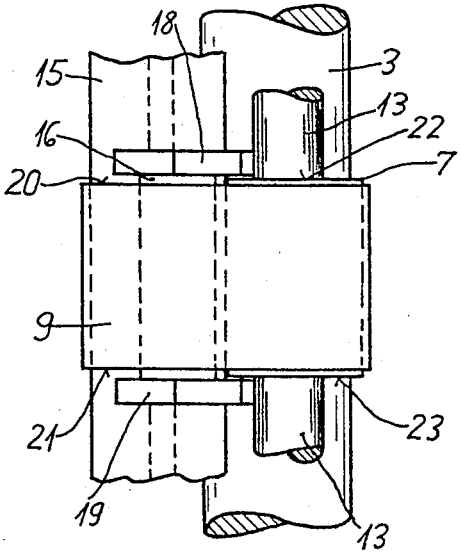
FIG. 2 is a plan view of this assembly.

To avoid confusion, the upper cage 11 has been omitted in the view represented in FIG. 2.

The upper cage 11 also has a pair of lugs 14 which engage the opposite edges of the belt 9 to prevent this belt from shifting laterally, i.e. parallel to the axis of the shaft 13.

The lower belt 10 not only passes over the lower roller 3 but also around a continuous and stationary turnover rail 15, around which the belt returns from the upper pass. Above the turnover rail 15 and in accordance with this invention, I provide a lateral guide element 16 for the lower belt 10. The lower guide element 17 comprises (see especially FIGS. 3 and 3A) a pair of parallel planar side walls 18 and 19 which are integral with and hence interconnected by, a web 17. The lateral guide elements 16 may be injection molded from synthetic resin.

The side walls 18 and 19 are so formed and arranged that they engage the edges 20 and 21 of the lower belt 10 at certain locations, e.g. adjacent the web 17, and at other locations engage the flanks 22 and 23 of the upper roller 7, these flanks forming abutments restricting the lateral mobility of the guide elements 16.

The flanks 22 and 23 here form spatially fixed abutments for the side walls 18 and 19 of the guide element 16 to prevent the belt guide element 16 from twisting or canting. The side walls 18 overlap or project over the edges of the upper and lower belts 9 and 10 sufficiently to enable the lower edge 24 of each side wall 18 and 19 to rest upon the turnover rail 12 from above.

Bulges **16*a* and 16*b* of these side walls flank the rise 15*a* of the rail 15 so that transverse shiftability of the lateral guide element 16** is precluded.

As noted, the element 16 is a form-stable injection molding of a low friction synthetic resin material. The web 17 is received in the loop of the upper belt 10 so that it can constitute a retainer for the latter belt as well.

Figure 4:
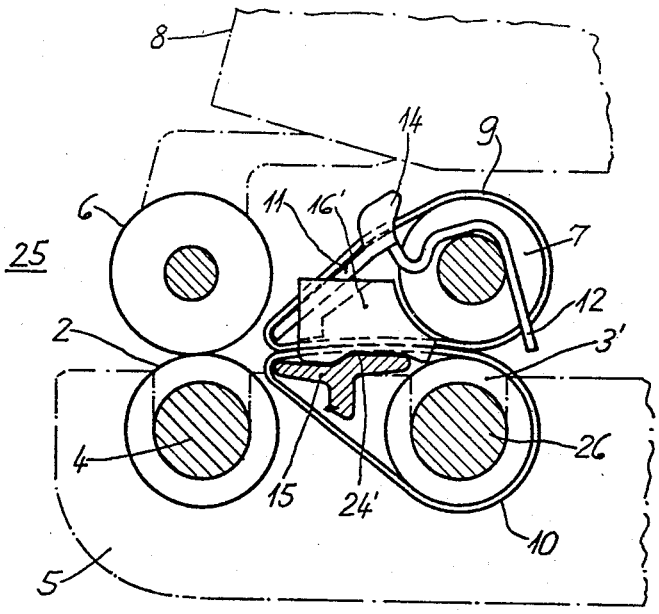
FIG. 4 is a longitudinal section through the output structure of another drafting frame embodying the invention.
Figure 5:
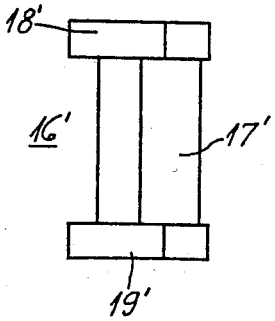
FIG. 5 is a top plan view of the lateral guide element used in this embodiment.
Figure 6:
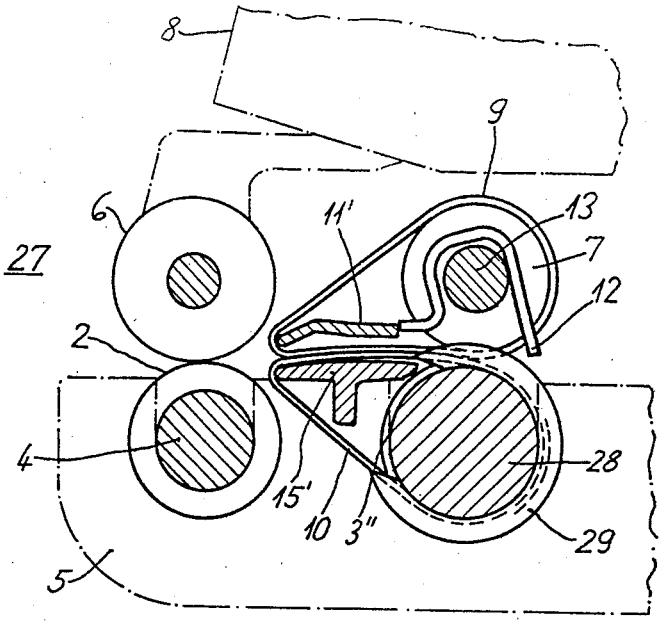
FIG. 6 is a section through a third drafting assembly in accordance with the invention.
Figure 8:
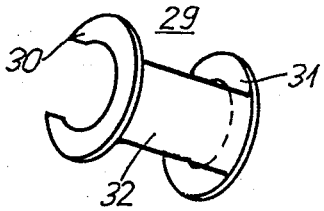
FIG. 8 is a perspective view of the lateral guide element.
Figure 9:
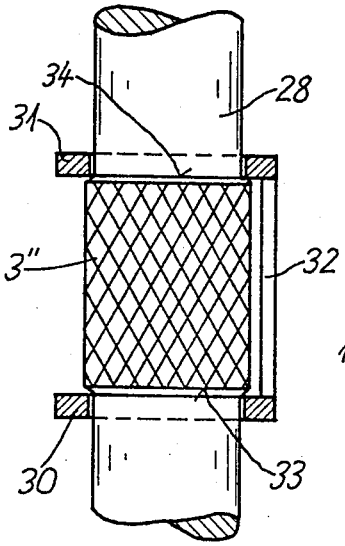
FIG. 9 is a view from above showing the lower roller of the drafting assembly of FIG. 6 but with the lateral guide element partly broken away.
Figure 7:
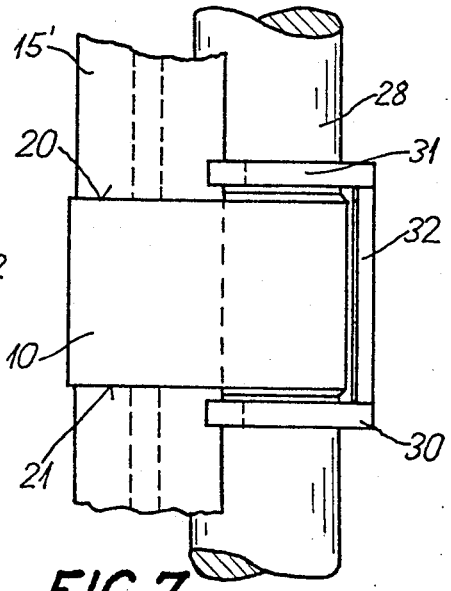
FIG. 7 is a top plan view of the assembly of FIG. 6.

A second embodiment of the invention has been illustrated in FIGS. 4 and 5. The drafting assembly 25 of these FIGURES comprises a lower roller 3' carried by a shaft 26. In this construction, the lateral guide element 16' has a somewhat different form. Here the side walls 18' and 19' are united by a web 17' inserted through the loop of the upper belt 9. The side walls 18' and 19' overlap or extend over the edges 9 and 10 from above so that the edge 24' rests from above on the turnover rail 15. From below, the side walls engage over the upper belt cage 11 so that the latter can form the spatially fixed abutment for the guide element 16'. By contrast with the first embodiment, therefore, in this embodiment the side walls 18' and 19' can be spaced somewhat from the periphery of the upper roller 7.

In a third embodiment shown in FIGS. 6–9, the drafting assembly 27 has generally the configuration of the embodiment of FIG. 1 although here the running surface of the lower roller 3'' has a slightly greater diameter than that of its shaft 28. The lateral guide element 29 is in this embodiment somewhat differently shaped and arranged.

The side walls 30 and 31 are formed as rings with cutouts while the web 32 is in the form of a cylindrical segment. The web 32 is disposed to the right, i.e. the rear, of the lower roller 32'' (see FIG. 6) while side walls 30 and 30 flank the edges 20 and 21 of the lower belt. The rings 30 and 31, moreover, overlap the flanks 33 and 34 of the running surface of the lower roller 3''. Because the flanks of the lower roller prevent shifting of the element 29 and the side walls 30, 31 in turn prevent lateral shifting of the belt 10, the latter is guided between the rings 30 and 31 safely. The stationary rail 15' reaches into the cutouts of the rings to prevent rotation of the guide element 29.

When flanks 33 and 34 are not provided, i.e. the roller is flush with its shaft 28, the rings 30 and 31 can extend sufficiently (FIG. 6) so that they can engage the flanks of the roller 7. The lateral guide element 29 is likewise injection molded of a form-stable elastic synthetic resin in one piece and the cutouts can extend over less than half of the circumference of the rings so that the rings can be snapped over the shaft 28. This simplifies mounting and dismounting of the lateral guide elements.

I claim:

1. A drafting assembly for a spinning machine, comprising, in combination:

a plurality of lower rollers at respective drafting stations;

a turnover rail extending through said stations proximal to said lower rollers;

a respective endless lower belt extending directly around each of said lower rollers and said rail and having an upper pass;

a respective upper roller disposed above each lower roller;

a respective upper endless belt passing around each upper roller and having a lower pass juxtaposed with a respective upper pass of a respective lower belt so that yarn can be drawn between said belts, said turnover rail having an upper surface underlying said upper pass substantially over the length thereon; and a respective lateral guide element at each of said stations, formed in one piece and lying wholly outside the lower belt of the respective station, each of said guide elements having a pair of side walls flanking at least said lower belt for guiding same while axially abutting and flanking ends of at least one of said rollers of the respective station, and a web connecting said side walls and lying outside the respective lower belt, said side walls engaging said upper surface to prevent canting of said element.

2. A drafting assembly for a spinning machine, comprising, in combination:

a plurality of lower rollers at respective drafting stations;

a turnover rail extending through said stations proximal to said lower rollers;

a respective endless lower belt extending directly around each of said lower rollers and said rail and having an upper pass;

a respective upper roller disposed above each lower roller;

a respective upper endless belt passing around each upper roller and having a lower pass juxtaposed with a respective upper pass of a respective lower belt so that yarn can be drawn between said belts, said turnover rail having an upper surface underlying said upper pass substantially over the length thereon; and a respective lateral guide element at each of said stations, formed in one piece and lying wholly outside the belts of the respective station, each of said guide elements having a pair of circularly segmental side walls flanking said lower belt for guiding same while axially abutting and flanking ends of said lower roller of the respective station, and a cylindrically segmental web connecting said side walls and lying outside the respective lower belt along an arc around said lower roller, said side walls engaging said upper surface to prevent canting of said element.

3. The assembly defined in claim 2 wherein said side walls overlap flanks of the respective upper roller at the respective station.

4. The assembly defined in claim 2 wherein said element is injection molded on a form-stable synthetic resin.

* * * * *